US005338570A

United States Patent [19]

Cressman

[11] Patent Number: 5,338,570

[45] Date of Patent: Aug. 16, 1994

[54] METHOD FOR FINISHING WOOD SLATTED ARTICLES OF FURNITURE

[75] Inventor: Thomas E. Cressman, Quakertown, Pa.

[73] Assignee: Westinghouse Electric Corp., Pittsburgh, Pa.

[21] Appl. No.: 18,958

[22] Filed: Feb. 18, 1993

[51] Int. Cl.[5] ..... B05D 3/12

[52] U.S. Cl. ..... 427/240; 427/440; 427/408; 427/232; 427/393

[58] Field of Search ..... 427/440, 240, 408, 393, 427/346, 397, 232; 118/52, 55, 56

[56] References Cited

U.S. PATENT DOCUMENTS

| | | | |
|---|---|---|---|
| 4,086,056 | 4/1978 | Hansen | 21/7 |
| 4,127,686 | 11/1978 | Motai | 427/351 |
| 4,191,796 | 3/1980 | Eckhoff | 427/408 |
| 4,218,516 | 8/1980 | Meyer et al. | 427/408 |
| 4,287,239 | 9/1981 | Hager | 427/351 |
| 4,376,141 | 3/1983 | Maddox | 427/370 |
| 4,612,255 | 9/1986 | Hein | 427/440 |
| 4,649,065 | 3/1987 | Hein et al. | 427/370 |
| 4,657,789 | 4/1987 | Lars | 427/372.2 |
| 4,686,121 | 8/1987 | Rogalla | 427/440 |
| 4,888,213 | 12/1989 | Hesterberg | 427/133 |
| 4,988,545 | 1/1991 | Laks | 427/440 |
| 5,051,283 | 9/1991 | Beane et al. | 427/440 |
| 5,154,486 | 10/1992 | Gehry | 297/445 |

FOREIGN PATENT DOCUMENTS

| | | | |
|---|---|---|---|
| 485014 | 12/1975 | U.S.S.R. | 427/240 |
| 5760 | of 1906 | United Kingdom | 427/240 |
| 654038 | 5/1951 | United Kingdom | 427/240 |
| 1081111 | 8/1967 | United Kingdom | 427/240 |

OTHER PUBLICATIONS

"Furniture with a Twist", *FDM* Magazine, pp. 20–32, published Jun., 1992.

*Primary Examiner*—Shrive Beck
*Assistant Examiner*—Diana L. Dudash
*Attorney, Agent, or Firm*—Carla J. Vrsansky

[57] ABSTRACT

A process for finishing wood slatted articles of furniture, such as chairs, tables and ottomans for either indoor or outdoor use comprising the steps of dipping the article in a coating material, draining the excess coating material and then spinning the article to provide an even distribution of the coating, particularly throughout the intricately woven slats of the article. The article is subsequently dried at room temperature and then heated in an oven to cure the coating material. The coating material may be comprised of an acrylic polymer resin. The article may be dipped in various other media, such as a color stain or an exterior protective sealer depending on the finishing application desired.

42 Claims, No Drawings

METHOD FOR FINISHING WOOD SLATTED ARTICLES OF FURNITURE

BACKGROUND OF THE INVENTION

1. Field of the Invention

This application relates to a process for finishing wood slatted articles of furniture, such as chairs, tables and ottomans, for example, for outdoor or indoor use, and, more particularly to a process for staining or coating the article of furniture in a way so as to completely cover the intricate woven slats of the article to provide an aesthetically pleasing, finished appearance that is both decorative and protective.

2. Description of the Related Art

Furniture is often required to be decorative but also functional without being subjected to degradation and becoming obsolete. This is particularly true of wood furniture that requires staining so as to adapt to a myriad of color schemes. The stain is expected to remain even after years of use. Often wood furniture is also desired for outdoor use which requires preservation to protect the furniture from the elements and prevent deterioration. Therefore it is extremely desirable that wood furniture, in particular intricately woven wood furniture, be subjected to finishing processes that provide aesthetic appeal as well as durability. These processes must also be economically feasible and easily tailored to accommodate furniture requiring indoor and/or outdoor applications.

Processes are well known in the art for staining wood and preserving wood from deterioration and microbial attack. These processes range from staining articles made of wood which are subjected to conditions of pressure and temperature to preserve the stain to accelerating drying of coatings and stains by suspending the articles from hooks while spinning the articles at an elevated temperature. Known wood preservation processes include treating the wood with solutions of fungicides and mildicides as well as aqueous salt solutions followed by air drying, heat drying or pressure to provide a barrier against wood degradation and microbial attack.

While the above noted processes refer to wood preservation and finishing, furniture constructed of intricately woven slats of wood requires special attention, in particular, furniture constructed of interwoven bent wood laminate slats arranged in an interlocking lattice structure. Such furniture and the method for manufacturing such furniture is discussed in U.S. Pat. No. 5,154,486 issued Oct. 13, 1992 to the same assignee as the present application and entitled "Furniture Comprising Laminated Slats and Methods of Manufacturing Such Furniture".

Consequently, a finishing process is desired that provides complete coverage of stains and coatings throughout the crevices formed from the intricately woven design of wood slatted furniture as well as provides protection from degradation and microbial attack when this furniture is required for outdoor use, such as outdoor cafes and patios. Furthermore, this much desired finishing process must be economically feasible while at the same time providing finished products that are both aesthetically appealing and durable.

SUMMARY OF THE INVENTION

A method for finishing wood slatted articles of furniture for indoor or outdoor use comprising the steps of dipping the article in a coating material, draining the excess coating material and then spinning the article to provide an even distribution of the coating, particularly throughout the intricately woven slats of the furniture. The article is subsequently dried at room temperature and then exposed to an elevated temperature to cure the coating material. Depending on the finishing application desired, for example indoor or outdoor use, the coating material may comprise various media, such as a clear topcoat, a color stain or an exterior protective sealer to provide a finished appearance that is both decorative and protective.

DESCRIPTION OF THE PREFERRED EMBODIMENT

This application relates to several finishing processes for furniture, for example, chairs, tables and ottomans, which are made of interwoven bent wood laminate slats arranged in an interlocking lattice structure, this furniture and the method for manufacturing such furniture being more fully described in U.S. Pat. No. 5,154,486. The various finishing procedures described below include a clear topcoat finishing process for maintaining a natural maple appearance; a color stain finishing process followed by the clear topcoat finishing process for presenting the furniture in a variety of decorator colors; and an exterior finishing process followed by the clear topcoat finishing process for protecting the furniture from weather degradation and microbial attack.

I. CLEAR TOPCOAT FINISHING PROCESS

This process which includes finishing interwoven wood slatted furniture with a clear topcoat, preferably an acrylic polymer resin, may be generally utilized in any of the finishing procedures that will be discussed presently. The clear topcoat provides a clear, protective shield to the furniture surface to prevent chips, nicks, or various other damaging effects which are a result of every day use. This process may be used either alone to provide a natural finish or in conjunction with the color stain finishing or exterior finishing to further provide a clear protective shield.

The clear topcoat finishing process will now be described. An article of furniture such as manufactured by the process described in U.S. Pat. No. 5,154,486 may be initially subjected to a stream of clean, compressed air at a rate of approximately 80 psi to remove any dust or wood shavings. The article may then be fastened to a tool balancer by means of a hook or a similar device in an inconspicuous area of the article such as the underside of a chair or table for example in order to treat the article to the clear topcoat finishing process. The article, being suspended from a hook on the tool balancer, may be dipped into a large, stainless steel tank containing a clear topcoat comprised of a modified acrylic polymer, such as one manufactured by Lilly Industries, Inc. of High Point, N.C. The tank may be approximately five feet deep, a depth that permits the entire article of furniture to be submerged at one time in the topcoat. The article may be submerged in the topcoat for a period from between about 10 seconds to about 20 seconds, preferably for about 15 seconds. The article may then be removed from the tank and suspended above the tank from between about 20 seconds to about 35 seconds, preferably for about 30 seconds, in order that the excess topcoat material drains from the article and back into the tank. The article may then be transferred to a spinning device where it may be spun at a velocity from about 80 RPM's to about 100 RPM's, preferably at a velocity of about 90 RPM's for a period from between about 40 seconds to about 60 seconds, preferably for about 45 seconds. These steps of dipping, draining and spinning provide an even distribution of the topcoat to all interwoven surfaces of the article of furniture. After spinning, the article may be removed from the spinning device and the damp areas of the article may be refinished with a foam pad. The article may then be permitted to air dry for a period from between about 10 minutes to about 20 minutes, preferably for about 15 minutes, until the topcoat is completely transparent and dry to the touch. After the topcoat has dried, the article may be placed in an oven, for example a steam kiln, and heated at a temperature from between about 125 degrees to about 140 degrees Fahrenheit, preferably at a temperature of about 130 degrees Fahrenheit for a period from between about 18 minutes to about 20 minutes, preferably for about 20 minutes in order to ensure that the topcoat is completely dry. The article may then be permitted to cool to the ambient temperature for a period from about 8 minutes to about 10 minutes, preferably for about 10 minutes. Once the article has cooled, the article may be hand sanded using 220 grit aluminum oxide to remove any rough edges. Any shavings or dust particles remaining from the sanding step may then be removed by a stream of air. Any markings remaining on the article may then be refinished using a maple shader as needed. A final coat, preferably a water-based polyurethane enamel, such as one manufactured by Lilly Industries, Inc. of High Point, N.C., having a viscosity of from between about 18 seconds to about 21 seconds, preferably at about 21 seconds on a Zahn #2 viscosity cup may be applied to the article by spraying to ensure that additional coating is applied to areas of the article that traditionally experience heavy use, for example the arm and seat surfaces of a chair. The article may then be placed in an oven, for example a steam kiln and heated at a temperature from between about 125 degrees to about 140 degrees Fahrenheit, preferably at a temperature of about 130 degrees Fahrenheit, for a period from between about 18 minutes to about 22 minutes, preferably for about 20 minutes to ensure that the polyurethane coat has adequately cured. The article may then be removed from the oven and permitted to cool for a period from between about 8 hours to about 10 hours, preferably for about 10 hours. The finished article may then be inspected for any rough edges or discrepancies and sanded using a material such as steel wool to create a smooth, even finish.

II. COLOR STAIN FINISHING PROCESS

The color stain finishing process will now be described. This process involves treating an article of furniture such as described in U.S. Pat. No. 5,154,486 with a color stain in order to provide such article in a variety of decorator colors, for example green, black or mahogany. The color stain finishing process may then be followed by the clear topcoat finishing process as described above to provide a clear, protective shield to enhance and maintain the color of the article.

A article of furniture such as manufactured by the process described in U.S. Pat. No. 5,154,486 may be initially subjected to a stream of clean, compressed air at a rate of approximately 80 psi to remove any dust or wood shavings. The article may then be fastened to a tool balancer by means of a hook or a similar device in an inconspicuous area of the article such as the underside of a chair or table for example in order to treat the article to the color stain finishing process. The article, being suspended from a hook on the tool balancer, may be dipped into a large, stainless steel tank containing one of a variety of color stains such as green, purple, black or mahogany. The color stain may be similar to a stain by Lilly Industries, Inc. of High Point, N.C., comprising a non toxic pigment in a water carrier with a VOC (Volatile Organic Compound) under 2.0 pounds per gallon.

The tank may be approximately five feet deep, a depth that permits the entire article of furniture to be submerged at one time in the color stain. The article may be submerged in the color stain for a period from between about 10 seconds to about 20 seconds, preferably for about 15 seconds. The article may then be removed from the tank and suspended above the tank from between about 20 seconds to about 35 seconds, preferably for about 30 seconds, in order that the excess color stain material drains from the article and back into the tank. The article may then be 30 transferred to a spinning device where it may be spun at a velocity from about 80 RPM's to about 100 RPM's, preferably at a velocity of about 90 RPM's for a period from between about 40 seconds to about 60 seconds, preferably for about 45 seconds. These steps of dipping, draining and spinning provide an even distribution of the color stain to all interwoven surfaces of the article of furniture. After spinning, the article may be removed from the spinning device and the damp areas of the article may be refinished with a foam pad. The article may then be permitted to air dry for a period from between about 5 minutes to about 10 minutes, preferably for about 10 minutes, until the color stain is completely transparent and dry to the touch. After the color stain has dried, the article may be placed in an oven such as a steam kiln and heated at a temperature from between about 125 degrees to about 140 degrees Fahrenheit, preferably at a temperature of about 130 degrees Fahrenheit, for a period from between about 18 minutes to about 20 minutes, preferably for about 20 minutes in order to ensure that the color stain is completely dry. The article may then be permitted to cool to the ambient temperature for a period from about 8 minutes to about 10 minutes, preferably for about 10 minutes. Thereafter, the above discussed steps of dipping in the color stain, draining, spinning, air drying, oven drying and cooling may be repeated in the same order at the above prescribed conditions. Once these repeat steps are completed, the article may be further sprayed with the appropriate stain color in order to ensure obtaining the desired shade of color. The article may then be air dried for a period from between about 45 minutes to about 1 hour, preferably for about 1 hour or the article may be oven dried for a period from between about 12 minutes to about 15 minutes, preferably for about 15 minutes at a temperature from between about 125 degrees to about 140 degrees Fahrenheit, preferably at a temperature of about 130 degrees Fahrenheit. The article may then be dipped into a tank of stain block, such as an aqueous stain blocker manufactured by Lilly Industries, Inc. of High Point, N.C., and described in U.S. Pat. No. 5,051,283 for a period from between about 10 seconds to about 15 seconds, preferably for about 15 seconds. The article may then be suspended above the tank and permitted to drain above the tank for a period from between about 20 seconds to about 30 seconds, preferably for about 30 seconds, in order to remove the excess stain block. After the draining step, the article may be transferred to the spinning device where it is spun at a velocity from about 80 RPM's to about 100 RPM's, preferably at a velocity of about 90 RPM's for a period from between about 40 seconds to about 60 seconds, preferably for about 45 seconds. These steps of dipping, draining and spinning provide an even distribution of the stain block to all interwoven surfaces of the article of furniture. After spinning, the article may be removed from the spinning device and the damp areas of the article may be refinished with a foam pad. The article may then be placed in an oven such as a steam kiln and heated at a temperature from between about 125 degrees to about 140 degrees Fahrenheit, preferably at a temperature of about 130 degrees Fahrenheit for a period from between about 18 minutes to about 20 minutes, preferably for about 20 minutes in order to ensure that the stain block is completely dry. The article may then be permitted to cool to the ambient temperature for a period from about 8 minutes to about 10 minutes, preferably for about 10 minutes. Finally, the article may be treated with the clear topcoat finishing process as fully described above in Section I in order to provide a clear, protective shield to the furniture surface to prevent chips, nicks, or various other damaging effects which may be a result of every day use.

III. EXTERIOR FINISHING PROCESS

Finally, the exterior finishing process will be discussed in detail. This process may be utilized for treating an article such as one described in U.S. Pat. No. 5,154,486 so as to prevent damaging effects from weather and microbial attack when the article may be used in an outdoor setting. An article of furniture such as manufactured by the process described in U.S. Pat. No. 5,154,486 may be initially subjected to a stream of clean, compressed air at a rate of approximately 80 psi to remove any dust or wood shavings. The article may then be fastened to a tool balancer by means of a hook or a similar device in an inconspicuous area of the article such as the underside of a chair or table for example in order to treat the article to the exterior finishing process. The article, being suspended from a hook on the tool balancer, may be dipped into a large, stainless steel tank containing a solution which may comprise about 40% by weight of sodium borate. The sodium borate may be used as an effective means of preventing microbial attack. The tank may be approximately five feet deep, a depth that permits the entire article of furniture to be submerged at one time in the sodium borate solution. The article may be submerged in the sodium borate solution for a period from between about 8 seconds to about 10 seconds, preferably for about 10 seconds. The article may then be removed from the tank and suspended above the tank for a period from between about 25 seconds to about 30 seconds, preferably for about 30 seconds, in order that the excess sodium borate solution drains from the article and back into the tank. The article may then be transferred to a spinning device where it may be spun at a velocity from about 80 RPM's to about 100 RPM's, preferably at a velocity of about 90 RPM's for a period from between about 40 seconds to about 60 seconds, preferably for about 45 seconds. These steps of dipping, draining and spinning provide an even distribution and penetration of the sodium borate solution to all interwoven surfaces of the article of furniture. After spinning, the article may be placed in an oven such as a steam kiln and heated at a temperature from between about 125 degrees to about 140 degrees Fahrenheit, preferably at a temperature of about 130 degrees Fahrenheit, for a period from between about 18 minutes to about 20 minutes, preferably for about 20 minutes in order to ensure that the sodium borate coating is completely dry. The article may then be permitted to cool to the ambient temperature for a period from between about 8 minutes to about 10 minutes, preferably for about 10 minutes. Following the sodium borate treatment, the article may be dipped into a tank of exterior acrylic sealer such as one manufactured by Lilly Industries, Inc. of High Point, N.C., comprising a low glass transition temperature acrylic polymer in water base suspension with a VOC (Volatile Organic Compound) of 0.8 pounds per gallon or less and submerged in the exterior sealer for a period from between about 10 seconds to about 20 seconds, preferably for about 15 seconds. It should be noted that the exterior sealer may contain approximately 1% by volume of a fungicide, such as FUNGITROL manufactured by Huls America of New Jersey so as to protect the article from weather degradation and microbial attack. Thereafter, the article may be removed from the tank and suspended above the tank from between about 25 seconds to about 30 seconds, preferably for about 30 seconds, in order that the excess exterior sealer material drains from the article and back into the tank. The article may then be transferred to the spinning device where it is spun at a velocity from about 80 RPM's to about 100 RPM's, preferably at a velocity of about 90 RPM's for a period from between about 40 seconds to about 60 seconds, preferably for about 60 seconds. These steps of dipping, draining and spinning provide an even distribution and penetration of the exterior sealer to all interwoven surfaces of the article of furniture. After spinning, the article may be placed in an oven such as a steam kiln and heated at a temperature from between about 125 degrees to about 140 degrees Fahrenheit, preferably at a temperature of about 130 degrees Fahrenheit, for a period from between about 18 minutes to about 20 minutes, preferably for about 20 minutes in order to ensure that the exterior sealer coating is completely dry. The article may then be permitted to cool to the ambient temperature for a period from between about 8 minutes to about 10 minutes, preferably for about 10 minutes. Once the sodium borate treatment and exterior sealer steps have been completed, the exterior finishing process may be concluded with the clear topcoat finishing process as fully described above in section I in order to provide a clear, protective shield to the furniture surface to prevent chips, nicks, or various other damaging effects which may be a result of every day use as well as to protect the article from weather degradation and microbial attack, which may be often encountered when using wood furniture in an outdoor setting.

I claim:

1. A method for finishing an article of wood furniture comprising the steps of:

dipping said article into a coating material for at least about 10 seconds;

removing said article from said coating material and draining said article for at least about 20 seconds; and spinning said dipped and drained article for at least about 40 seconds at a rate of at least about 80

RPM's for evenly distributing said coating for finishing said article of furniture.

2. The method according to claim 1 wherein said dipping step is performed from about 10 seconds to about 20 seconds.

3. The method according to claim 2 wherein said dipping step is performed for approximately 15 seconds.

4. The method according to claim 3 wherein said draining step is performed from about 20 seconds to about 35 seconds.

5. The method according to claim 4 wherein said draining step is performed for approximately 30 seconds.

6. The method according to claim 5 wherein said rate for said spinning step is performed at a rate from about 80 RPM's to about 100 RPM's.

7. The method according to claim 6 wherein said spinning step is performed at a rate of approximately 90 RPM's.

8. The method according to claim 7 wherein said spinning step is performed for a period from about 40 seconds to about 60 seconds.

9. The method according to claim 8 wherein said spinning step is performed for a period of approximately 45 seconds.

10. the method according to claim 1 further including the step of drying said article for at least about 10 minutes for finishing said article.

11. The method according to claim 10 wherein said drying step includes air drying said article.

12. The method according to claim 11 wherein said article is dried at room temperature.

13. The method according to claim 12 wherein said drying step is performed for a period from about 10 minutes to about 20 minutes.

14. The method according to claim 13 wherein said drying step is performed for approximately 15 minutes.

15. The method according to claim 14 wherein said drying step further includes heating said article at a temperature of at least about 125 degrees Fahrenheit for at least about 18 minutes.

16. The method according to claim 15 wherein said drying step is performed at a temperature from about 125 degrees Fahrenheit to about 140 degrees Fahrenheit.

17. The method according to claim 16 wherein said drying step is performed at a temperature of approximately 130 degrees Fahrenheit.

18. The method according to claim 17, wherein said drying step is performed for a period from about 18 minutes to about 20 minutes.

19. The method according to claim 18 wherein said drying step is performed for approximately 20 minutes.

20. The method according to claim 15 further including the step of cooling said article for at least about 8 minutes.

21. The method according to claim 20 wherein said cooling step is performed at room temperature.

22. The method according to claim 21 wherein said cooling step is performed for a period from about 8 minutes to about 10 minutes.

23. The method according to claim 22 wherein said cooling step is performed for approximately 10 minutes.

24. The method according to claim 1 wherein said coating material comprises an acrylic polymer.

25. The method according to claim 1 wherein said coating material comprises a non-toxic pigment.

26. The method according to claim 1 wherein said coating material comprises a water-based acrylic polymer sealer including a fungicide for protecting said article from weather degradation and microbial attack.

27. A method for finishing a wood slatted article of furniture comprising the steps of:

dipping said article into a coating material for at least about 10 seconds;

removing said article from said coating material and draining said article for at least about 20 seconds;

spinning said dipped and drained article for at least about 40 seconds at a rate of at least about 80 RPM's for evenly distributing said coating;

drying said article for at least about 10 minutes; and cooling said article for at least about 8 minutes for finishing said article of furniture.

28. The method according to claim 27 wherein said drying step includes air drying said article at room temperature.

29. The method according to claim 28 wherein said drying step further includes heating said article at a temperature of at least about 125 degrees Fahrenheit.

30. The method according to claim 29 wherein said drying step is performed for a period of at least about 18 minutes.

31. The method according to claim 30 wherein said cooling step is performed at room temperature.

32. The method according to claim 27 wherein said coating material includes a clear topcoat comprising an acrylic polymer.

33. The method according to claim 27 wherein said coating material includes an exterior sealer comprising a water-based acrylic polymer including a fungicide.

34. The method according to claim 27 wherein said coating material includes a color stain comprising a nontoxic pigment.

35. The method according to claim 34 wherein the steps of dipping, draining, spinning, drying and cooling are repeated.

36. The method according to claim 27 including the step of applying an additional protective coating to said article of furniture.

37. The method according to claim 36 wherein said protective coating comprises a water-based polyurethane enamel.

38. The method according to claim 37 further including the step of heating said article for curing said protective coating.

39. The method according to claim 38 wherein said heating step is performed at a temperature of at least about 125 degrees Fahrenheit.

40. The method according to claim 39 wherein said heating step is performed for a period of at least about 18 minutes.

41. The method according to claim 40 further including the step of cooling said article to ensure that said protective coating is dry.

42. The method according to claim 41 wherein said cooling step is performed for a period of at least about 8 hours.

* * * * *